US007111690B2

(12) United States Patent
Kleinert

(10) Patent No.: US 7,111,690 B2
(45) Date of Patent: Sep. 26, 2006

(54) MANUAL SLIDE POST DRIVER AND EXTRACTOR FOR "T"-TYPE METAL OR FIBERGLASS OR PLASTIC POSTS

(76) Inventor: R. Amil Kleinert, 6921 Stacy Rd., Charlestown, IN (US) 47111

( * ) Notice: Subject to any disclaimer, the term of this patent is extended or adjusted under 35 U.S.C. 154(b) by 140 days.

(21) Appl. No.: 10/434,539

(22) Filed: May 9, 2003

(65) Prior Publication Data

US 2004/0026095 A1 Feb. 12, 2004

Related U.S. Application Data

(60) Provisional application No. 60/379,255, filed on May 10, 2002.

(51) Int. Cl.
*B25D 9/00* (2006.01)

(52) U.S. Cl. ..... 173/90; 173/91; 173/128; 173/132

(58) Field of Classification Search ..... 173/90, 173/91, 128, 132, 170; 175/19
See application file for complete search history.

(56) References Cited

U.S. PATENT DOCUMENTS

| | | | | |
|---|---|---|---|---|
| 1,764,223 | A * | 6/1930 | Osten | 173/129 |
| 2,629,985 | A * | 3/1953 | McDowell | 173/91 |
| 2,690,055 | A * | 9/1954 | Lundgren et al. | 405/232 |
| 3,050,095 | A * | 8/1962 | Prather | 144/195.5 |
| 3,499,497 | A * | 3/1970 | Moore | 173/129 |
| 5,010,710 | A * | 4/1991 | Gray et al. | 52/741.14 |
| 5,042,591 | A * | 8/1991 | Hull | 173/91 |
| 5,085,281 | A * | 2/1992 | Selly | 173/91 |

* cited by examiner

*Primary Examiner*—John Sipos
*Assistant Examiner*—Nathaniel Chukwurah
(74) *Attorney, Agent, or Firm*—J. L. Simunic

(57) ABSTRACT

A post driving device is disclosed. The post driving device slides to a desired position and is essentially locked in place through frictional force. As the post is driven into the ground, the device can be adjusted to a new position along the length of the post.

13 Claims, 4 Drawing Sheets

MANUAL SLIDE POST DRIVER AND EXTRACTOR FOR "T"-TYPE METAL OR FIBERGLASS OR PLASTIC POSTS

CROSS-REFERENCE TO PRIOR APPLICATIONS

The present application claims priority to U.S. provisional patent application No. 60/379,255 filed May 10, 2002 and incorporated herein by reference.

BACKGROUND

Posts are used in a variety of applications as structural supports. To provide optimal support, the post must be driven into the ground. This is commonly accomplished by applying a driving force to the top of the post. If the post is tall, an installer may need to stand on the back of a truck bed or balance from a ladder to be above the height of the post. The installer then proceeds to drive the post into the ground with a sledge hammer or similar device. This procedure can be dangerous for the installer and may result in poor or incorrect positioning of the post, including twisting of the post. Further, because the driving force is applied to the top of the post, the post can be easily weakened or otherwise damaged during installation.

SUMMARY OF THE PRESENT INVENTION

The present development is a post driver device that slides over the top of a post before the post is raised to a standing position. The post driver device slides to a desired position and is essentially locked in place through frictional force. As the post is driven into the ground, the device can be adjusted to a new position along the length of the post. Because the post driver device is secured about the body of the post during installation, the post can be held in proper position leading to better alignment of the post. In addition, the driving force is applied through the body of the post rather than strictly at the top so the post is not damaged.

DETAILED DESCRIPTION OF THE INVENTION

Figure 1:
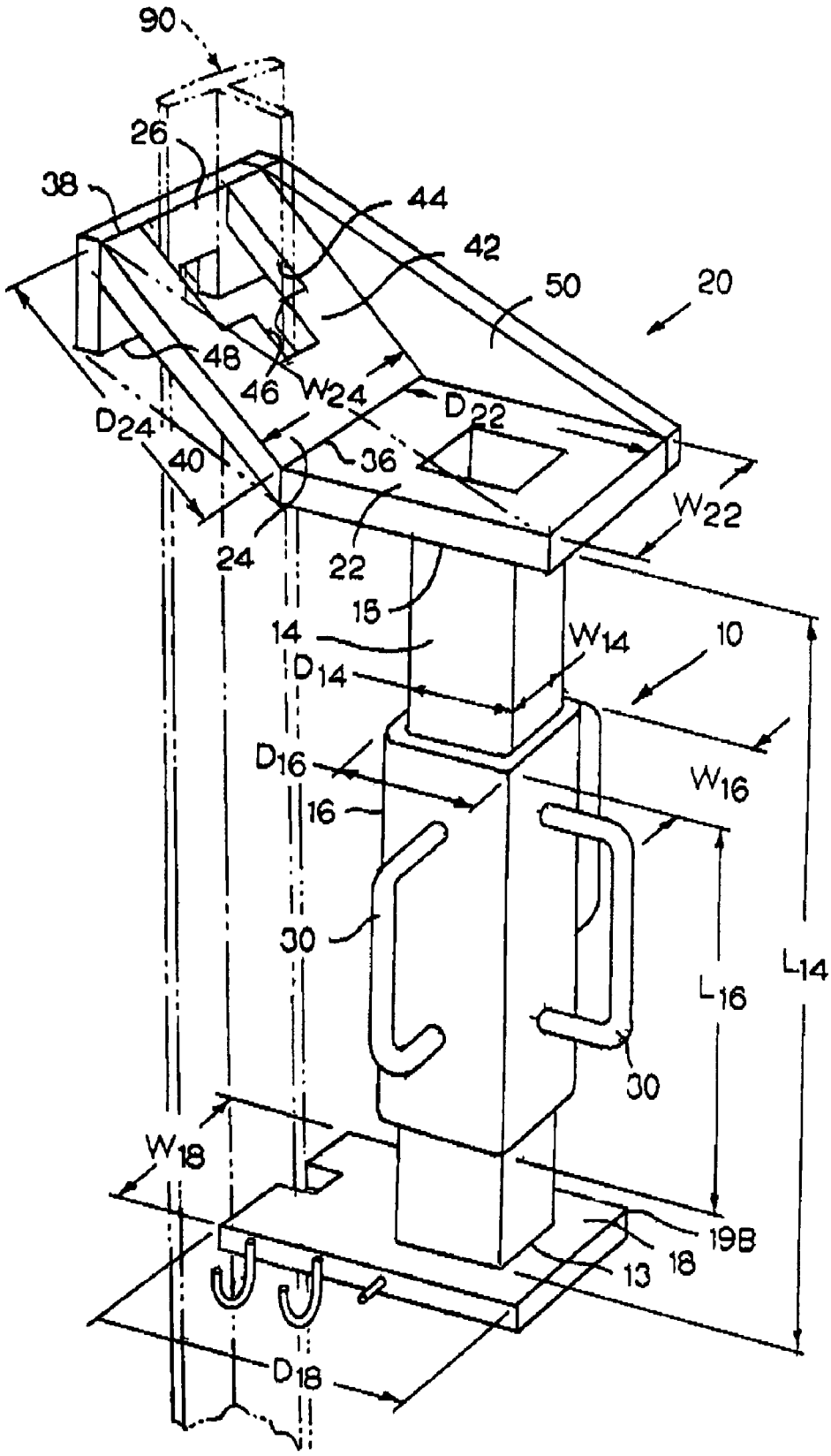
FIG. 1 is a perspective view of a post driver device made according to the present invention.
Figure 2:
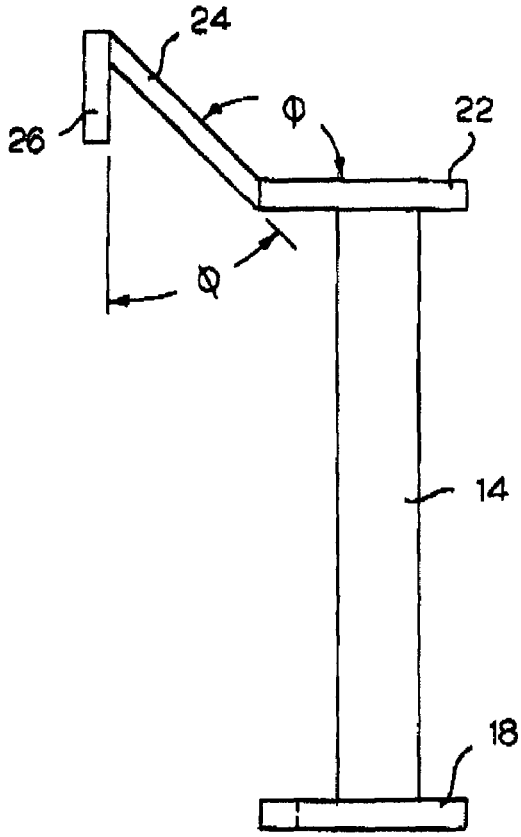
FIG. 2 is a side view of the driver of FIG. 1 with the slide driver removed.
Figure 3:
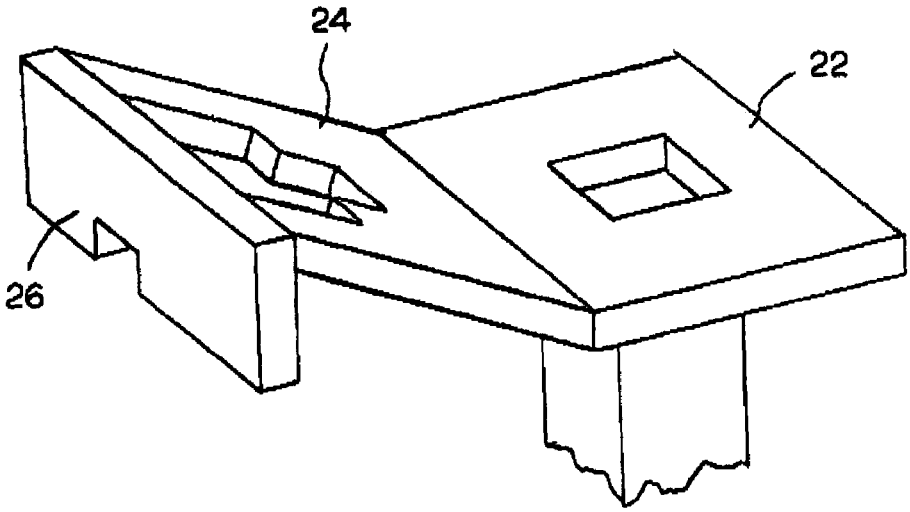
FIG. 3 is a perspective view of the top of the driver of FIG. 1.

The present development is a post driver device. The device is intended to be used with T-type posts such as are commonly used to support fencing materials. When the device is made according to the present invention, it can be used to drive T-type posts into the ground or to extract the posts from the ground. Specific dimensions relevant to the post driver device components are provided herein for the purpose of demonstrating the invention, but these dimensions are not intended to limit the scope of the invention. The dimensions are based on the assumption that the post driver device would be used to install or remove standard commercially available T-posts, but it is anticipated that the device could be used with posts having different dimensions and the device dimensions may be adjusted accordingly.

FIGS. 1–6B show a first embodiment of a post driver device 10 having a slide guide 14, a slide driver 16, a bottom plate 18 and a top locking plate section 20. The locking plate section 20 includes a slide plate 22, a post mounting plate 24 and a latching plate 26. The slide guide 14 has a first end 13 fixedly attached to the bottom plate 18 and a second end 15 fixedly attached to the slide plate 22. The slide driver 16 forms a moveable sleeve encircling the slide guide 14.

The slide guide 14 is a columnar unit positioned between the bottom plate 18 and the slide plate 22. In the device 10, the slide guide 14 is illustrated as a hollow column having an essentially square cross-section. The representative embodiment 10 has an external width $W_{14}$ of about 2½ inches, an external depth $D_{14}$ of about 2½ inches, and an external length $L_{14}$ of about 24 inches. The wall thickness may vary but should be adequate to sustain the forces generated when the slide driver 16 is raised and lowered along the slide guide 14. The slide guide 14 may have alternative cross-sectional shapes, such as circular, oval, rectangular or any shape that can accommodate a moveable sleeve. Optionally, the slide guide 14 may have a solid or filled core or interior and function as intended.

The slide driver 16 is a tubular unit positioned over the slide guide 14 between the bottom plate 18 and the slide plate 22. In the device 10, the slide driver 16 includes a plurality of handles 30 affixed to the driver 16 such that a user could grasp a pair of handles 30 and lower or raise the driver 16 with some measure of force against either the bottom plate 18 or the slide plate 22. When the driver 16 hits the respective plate 18, 22, the force is transferred to the post thereby driving the post the ground or extracting the post from the ground. A three-handled unit similar to the post driver device 10 allows the user flexibility for positioning the device 10 relative to the post and for operating the slide driver 16. However, the number and positioning of the handles 30 may vary and the handles 30 are not a required element of the invention, i.e. a no handle device is anticipated within the scope of the present invention.

Because the user can indirectly affect the force imparted to the post by the speed with which the slide driver 16 hits the bottom plate 18 or the slide plate 22, it is preferable that the slide driver 16 be designed to move smoothly along the slide guide 14 without excessive wobble or other undesired motion. The driver 16 should also be sized so as to allow the user adequate up-and-down movement along the slide guide 14. The slide driver 16 of the representative embodiment 10 has an external width $W_{16}$ of about 3 inches, an external depth $D_{16}$ of about 3 inches, a driver wall thickness $T_{16}$ of about ⅜ inches and an external length $L_{16}$ of about 12 inches.

The bottom plate 18 is fixedly attached to the first end 13 of the slide guide 14. The bottom plate 18 includes a notch 32 on a post face 17 of the plate 18. The notch 32 is positioned so as to engage a tail 92 of the post 90 when the post 90 is inserted through the post driver device 10 and is preferably about equidistant from the side edges 19A, 19B of the plate 18. The notch 32 functions to maintain the alignment of the post 90 as it is driven into the ground. Optionally, a hook or brad or chain link or similar means 34 to attach a belt or strap or chain or similar collar (not shown) may be attached to one or both sides 19A, 19B of the bottom plate 18 to allow the user to reversibly secure the bottom plate 18 to the post 90.

The bottom plate 18 must be larger than the external dimensions of the slide driver 16 to ensure that the driver 16 will be held on the slide guide 14. Further, the plate 18 must be large enough so that when the driver 16 is in contact with the bottom plate 18 the notch 32 is not obstructed by the driver 16. The bottom plate 18 of the representative embodiment 10 has an external width $W_{18}$ of about 4½ inches and an external depth $D_{18}$ of about 4½ inches, with the notch 32 having a width $W_{32}$ of about ⅜ inches and a depth $D_{32}$ of about ¾ inches positioned along the post face about 2 1/16 inches from each side 19A, 19B.

Referring to FIGS. 1–5, the top locking plate section 20 includes the slide plate 22, the post mounting plate 24 and the latching plate 26. The slide plate 22 is fixedly attached to the second end 15 of the slide guide 14 such that the slide plate 22 lies essentially parallel to the bottom plate 18. Similar to the bottom plate 18, the slide plate 22 must be larger than the external dimensions of the slide driver 16 to ensure that the driver 16 will be held on the slide guide 14. Optionally, the slide plate 22 may have peripheral dimensions similar to the bottom plate 18. The slide plate 22 of the representative embodiment 10 has an external width $W_{22}$ of about 3½ inches and an external depth $D_{22}$ of about 4 inches.

The post mounting plate 24 defines a first edge 36, a second edge 38, a pair of sides 40 and an aperture 42. The mounting plate 24 is secured to the slide plate 22 along the first edge 38 such that the mounting plate 24 is angled away from the slide guide 14 and essentially overhangs the notch 32 of the bottom plate 18. In the embodiment 10, the post mounting plate 24 forms an angle θ of approximately 135° relative to the slide plate 22, but the angle θ may vary as necessary to allow the post mounting plate 24 to properly engage the T-post. The post mounting plate 24 of the representative embodiment 10 has an external width $W_{24}$ of about 3½ inches and an external depth $D_{24}$ of about 3 inches.

Figure 6A:
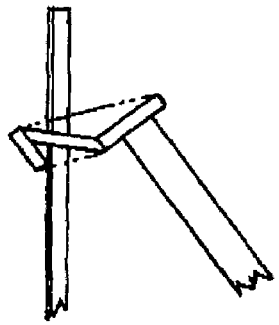
FIGS. 6A and 6B are side views of the driver of FIG. 1 as it is attached to the T-type post and as is positioned to drive the post into the ground, respectively.
Figure 6B:
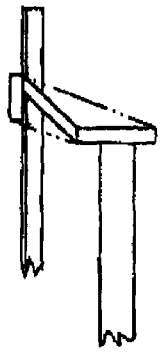

The aperture 42 abuts the second edge 38 and is contoured to allow the post 90 to be projected through the aperture 42 when the post mounting plate 24 is essentially perpendicular to the post 90, as shown in FIG. 6A, but further allows the post mounting plate 24 to be tilted to about a 45° angle relative to the post 90, as shown in FIG. 6B. Referring again to FIG. 4, the aperture 42 is preferably designed and sized to allow the tail 92 to be held securely within the post mounting plate 24 during use. For example, in the embodiment 10, the aperture 42 has a body void section 44 measuring about 1½ inches by 1½ inches contiguous with the second edge 38 and about 1 inch from either side 40. The aperture 42 further includes a tail void section 46 measuring about ¾ inch depth by about ⅜ inch width.

The mounting plate 24 is affixed to the latching plate 26 along the second edge 38. The latching plate 26 projects downward in the direction of the bottom plate 18 and is angled relative to the mounting plate 24 to form an angle ϕ of about 45°. Along a lower edge 48, the latching plate 26 includes a notch 28 that is essentially collinear with the tail void section 46. The notch 28 provides a means for the latching plate 26 to reversibly engage a tooth 94 on the post 90 thereby securing the post driver device 10 to the post 90 during use. The notch 28 further facilitates mounting the driver 10 on the post 90 because when the driver 10 is angled to insert the post 90, the notch 28 creates a bypass for the teeth 94.

Optionally, the top locking plate section 20 may include one or more side braces 50 to further adjoin the slide plate 22 and the post mounting plate 24, or the slide plate 22, the post mounting plate 24 and the latching plate 26. The braces 50 provide added strength to the top locking plate section 20 and, in particular, help to retain the relative angles of the plates.

Figure 4:
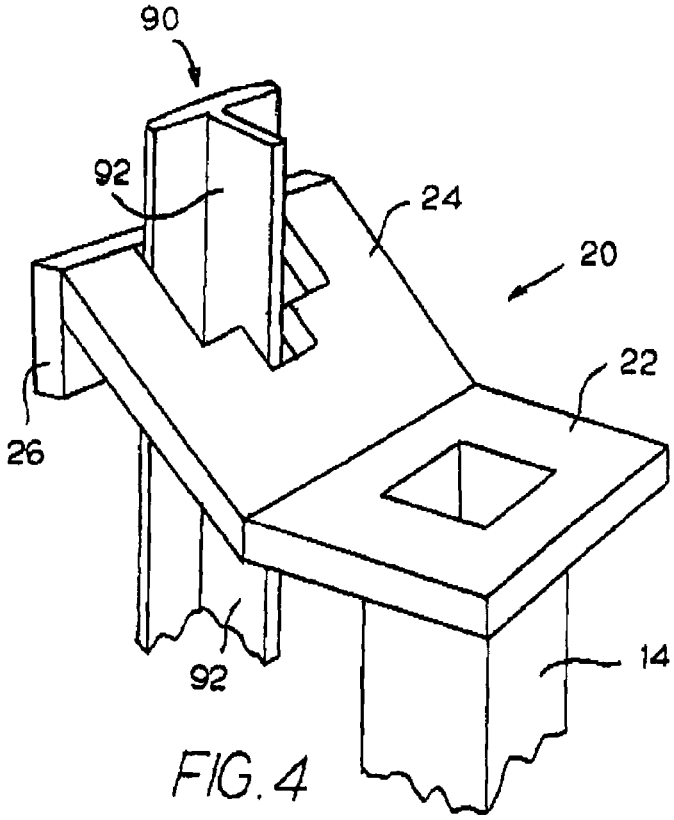
FIG. 4 is a top rear perspective view of the driver of FIG. 1 with a T-type post positioned within the driver and with the side plates removed to expose detail of the top locking plate section.
Figure 5:
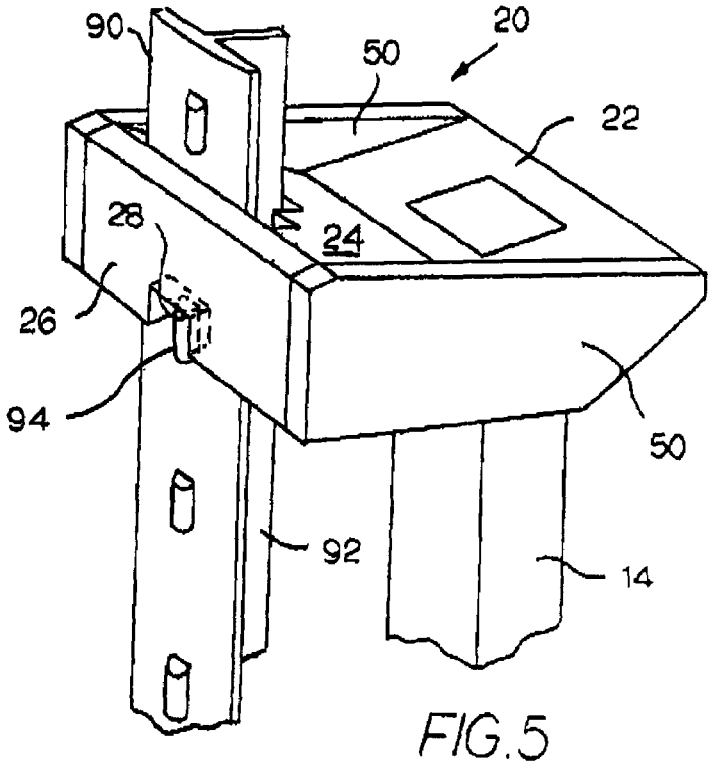
FIG. 5 is a top front perspective view of the driver of FIG. 1 with a T-type post positioned within the driver.

To use the post driver device 10, as shown in FIG. 6A the device 10 is angled to allow the post 90 to slide into the aperture 42. The post 90 is inserted to the desired height and the slide guide 14 is then tilted downward into a use-position as shown in FIG. 6B until the notch 32 of the bottom plate 18 engages the tail 92 of the post 90. In the use-position, the latching plate 26 is essentially perpendicular to the body 96 of the post 90 and the notch 28 can be aligned to engage the tooth 94, as shown in FIG. 5. Further, as shown in FIG. 4, in the use-position, the tail 92 is constrained within the tail void section 46. The post 90 is then driven into the ground by raising the slide driver 16 along the slide guide 14 and dropping it with some force against the bottom plate 18. Because the tail 92 is held firm at two points—at the notch 32 and at the tail void section 46—and because the post 90 is also held along the front edge by the tooth's interaction with the notch 28, there is little risk that the post 90 will shift or twist or otherwise become misaligned during installation. Should the user desire to extract the post 90, the post driver device 10 can be positioned in a manner similar to the positioning for installation but the slide driver 16 is projected with force toward the slide plate 22.

Figure 7:
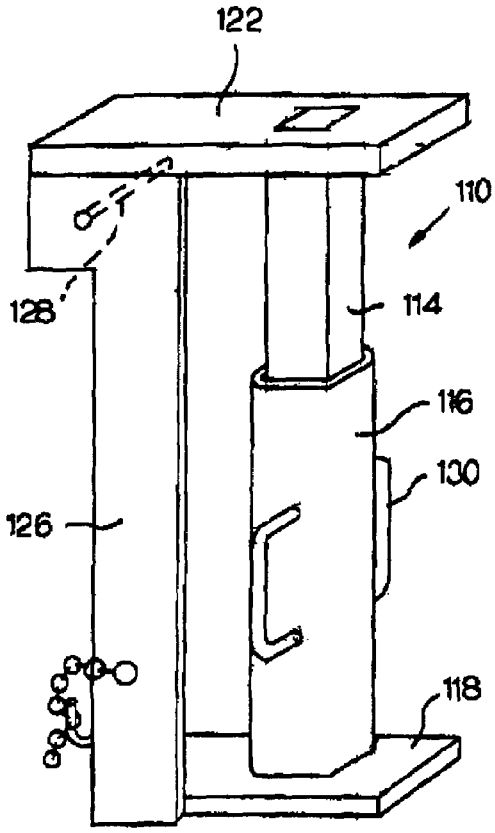
FIG. 7 is a perspective side view an alternative embodiment of a post driver device made according to the present invention.
Figure 8:
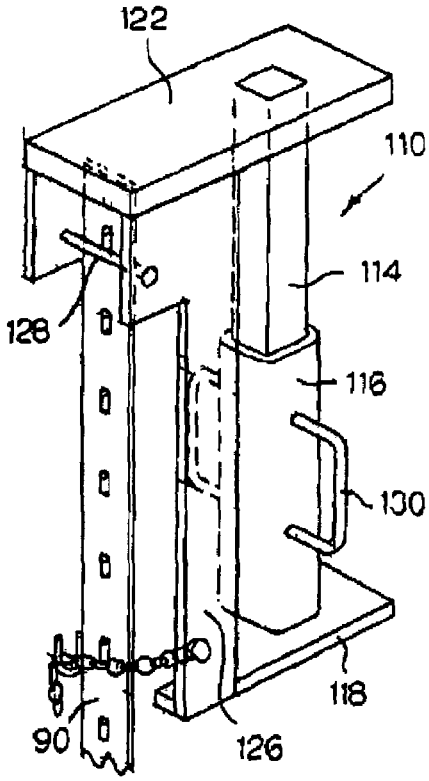
FIG. 8 is front view of the driver of FIG. 7 with a T-type post positioned within the driver.

An alternative embodiment 110 of the post driver device is shown in FIGS. 7 and 8. Similar to the device 10 of FIGS. 1–6, the device 110 comprises a slide guide 114, a slide driver 116 with optional handles 130 and a notched bottom plate 118. The device 110 combines the slide plate 22 and the post mounting plate 24 into a one piece top unit 122 that is fixedly attached to a post slide 126. Adjustable rods or pins 128 positioned near the top unit 122 reversibly secure the upper portion of the post 90 during installation. A chain or belt or similar strapping can be used to secure a lower portion of the post 90 near the bottom plate 118 during installation. The device 110 does not allow for the post to project through the device 110 but rather the top of the post 90 is contacted by the top unit 122 to drive the post 90 into the ground.

It is understood that one skilled in the art may make alterations to the embodiments shown and described herein without departing from the scope of the invention. For example, although the embodiments depicted use square/rectangular slide guides, slide drivers and related end plates, it is anticipated that other shapes, such as cylinders, would function as intended. Further, the shapes may be mixed so that a cylindrical slide guide and-slide driver could be used with square/rectangular end plates.

What is claimed is:

1. A post driving device comprising:

a. a bottom plate;

b. a top locking plate section comprising a slide plate, a post mounting plate having an aperture and a latching plate, said mounting plate being secured to the slide plate such that said mounting plate is angled relative to said slide plate by a predetermined angle, and said latching plate being fixedly attached to said mounting plate opposite said slide plate;

c. a slide guide, having a first end fixedly attached to said bottom plate and a second end fixedly attached to said slide plate; and d. a slide driver mounted on said slide guide such that said driver moves between said bottom plate and said top locking plate section while being retained on said slide guide.

2. The post driving device of claim 1 wherein said mounting plate aperture is contoured to allow said post to be projected through said aperture when said post mounting plate is essentially perpendicular to said post and when said post mounting plate is tilted to about a 45° angle relative to said post.

3. The post driving device of claim 1 wherein said aperture has a first void section to accommodate a body section of said T-type post adjacent said mounting plate and said aperture has a second void section to accommodate a tail of said T-type post.

4. The post driving device of claim 1 wherein said latching plate further comprises a notch to reversibly engage a tooth on said T-type post.

5. The post driving device of claim 1 wherein said bottom plate further comprises a notch for engaging a tail of said T-type post.

6. The post driving device of claim 1 further comprising at least one handle fixedly attached to said slide driver.

7. The post driving device of claim 6 wherein said slide driver further comprises three handles.

8. The post driving device of claim 1 further comprising at least one side brace adjoining said post mounting plate to said slide plate.

9. A post driving device comprising:

a. a bottom plate, having a T-post tail-engaging notch;

b. a slide guide, having a first end fixedly attached to said bottom plate and a second end opposing said first end;

c. a top locking plate section comprising a slide plate, a post mounting plate having an aperture, and a latching plate having a T-post tooth-engaging notch, wherein said slide plate is fixedly attached to the second end of said slide glide, and said post mounting plate is secured to the slide plate such that said mounting plate is angled away from said slide guide by a predetermined angle, and said latching plate is fixedly attached to said mounting plate opposite said slide plate such that the tooth-engaging notch faces toward said bottom plate; and d. a slide driver, having at least one handle, mounted on said slide guide such that said driver moves between said bottom plate and said top locking plate section while being retained said slide guide, and wherein said post mounting plate aperture is aligned relative to said bottom plate tail-engaging notch and to said latching plate tooth-engaging notch such that a T-type post having a tail and a tooth projects through said aperture by a predetermined length and said post tail can be engaged by said tail-engaging notch concurrently with said post tooth being engaged by said tooth-engaging notch.

10. The post driving device of claim 9 wherein said mounting plate aperture is contoured to allow said post to be projected through said aperture when said post mounting plate is essentially perpendicular to said post and when said post mounting plate is tilted to about a 45° angle relative to said post.

11. The post driving device of claim 10 wherein said aperture has a first void section to accommodate a body section of said T-type post adjacent said mounting plate and said aperture has a second void section to accommodate a tail of said T-type post.

12. The post driving device of claim 9 wherein said latching plate further comprises a notch to reversibly engage a tooth on said T-type post.

13. The post driving device of claim 9 further comprising at least one side brace adjoining said post mounting plate to said slide plate.

* * * * *